US009991629B1

(12) United States Patent
Chien et al.

(10) Patent No.: US 9,991,629 B1
(45) Date of Patent: Jun. 5, 2018

(54) MAGNETIC AUTOMOBILE VEHICLE DEVICE AND MULTIFUNCTIONAL MODULE THEREOF

(71) Applicant: C.C.P. CONTACT PROBES CO., LTD., New Taipei (TW)

(72) Inventors: Hao-Wen Chien, New Taipei (TW); Li-Chun Lan, New Taipei (TW); Min-An Ching, New Taipei (TW); Ping-Huan Tsou, New Taipei (TW); Wen-Ying Cheng, New Taipei (TW); Bor-Chen Tsai, New Taipei (TW); Tsung-Ming Tsai, New Taipei (TW); Chih-Feng Chen, New Taipei (TW)

(73) Assignee: C.C.P. CONTACT PROBES CO., LTD., New Taipei (TW)

( * ) Notice: Subject to any disclaimer, the term of this patent is extended or adjusted under 35 U.S.C. 154(b) by 0 days. days.

(21) Appl. No.: 15/588,687

(22) Filed: May 7, 2017

(51) Int. Cl.
*H01R 13/62* (2006.01)
*H01R 33/945* (2006.01)

(52) U.S. Cl.
CPC ..... *H01R 13/6205* (2013.01); *H01R 33/945* (2013.01)

(58) Field of Classification Search
CPC ..... H01R 24/58; H01R 13/6205
USPC ..... 439/668
See application file for complete search history.

(56) References Cited

U.S. PATENT DOCUMENTS

| | | | | |
|---|---|---|---|---|
| 7,844,303 | B2 * | 11/2010 | Jubelirer | H04B 1/034 248/229.1 |
| 8,167,633 | B1 * | 5/2012 | Wu | H01R 13/6675 439/164 |
| 8,177,560 | B2 * | 5/2012 | Rohrbach | H01R 13/6205 439/39 |
| 9,390,625 | B2 * | 7/2016 | Green | G07C 5/008 |
| 2012/0322514 | A1 * | 12/2012 | Seil | B60R 11/02 455/573 |
| 2015/0091380 | A1 * | 4/2015 | Chang | H01R 27/02 307/23 |

* cited by examiner

*Primary Examiner* — Ross Gushi
(74) *Attorney, Agent, or Firm* — Leong C. Lei

(57) ABSTRACT

Disclosed are a magnetic automobile vehicle device and its multifunctional module. The magnetic automobile vehicle device obtains electric power from a cigarette lighter slot of an automobile vehicle and includes a first magnet and an impact detector. The impact detector generates a distress signal when the automobile vehicle is collided. The multifunctional module includes a second magnet and an output element coupled to the magnetic automobile vehicle device by magnetic attraction and provided for charging or supplying power to the output element, and the output element has an ultrasonic transmitter, a USB slot or an $O_3$ air purifier. Therefore, the device comes with a multifunctional configuration and meets market and consumer requirements.

6 Claims, 9 Drawing Sheets

MAGNETIC AUTOMOBILE VEHICLE DEVICE AND MULTIFUNCTIONAL MODULE THEREOF

FIELD OF THE INVENTION

The present invention relates to the field of automobile vehicle devices, and more particularly to a magnetic automobile vehicle device and its multifunctional module, wherein after the magnetic automobile vehicle device is plugged into a cigarette lighter slot, the multifunctional module extends the application of a power supply of a cigarette lighter variously.

BACKGROUND OF THE INVENTION

Description of the Related Art

In an automobile vehicle, a cigarette lighter is an electrical device originally designed for lighting cigarettes. With the evolution of time, cigarette lighters are no longer used as much, but they are not abandoned immediately since the cigarette lighter has been a standard equipment of the automobile vehicle for a long time. To make the best use of the cigarette lighters, the present cigarette lighter slot is often used as a 12 VDC power supply interface. To obtain the electric power for the operation of products other than cigarette lighters such as satellite navigators, automobile rechargeable battery or automobile vacuum cleaner through the cigarette lighter slot, it is necessary to have a cigarette lighter socket for lighting cigarettes and a built-in power conversion circuit. For example, an automobile vehicle 1 having an automobile USB rechargeable battery as shown in FIG. 1 comprises a socket 10, a power connector 11 and a USB slot 12, and the power connector 11 is provided for electrically coupling a 12V power coil of the cigarette lighter slot to obtain the required electric power of the automobile vehicle device 1 and allow an external electronic device to obtain electric charge through a USB cable and the USB slot 11.

The common satellite navigator, automobile vacuum cleaner, or any extended product other than the cigarette lighter is a standalone and non-detachable device. To prevent the automobile vehicle device 1 from being protruded to much from the cigarette lighter slot or affecting the setting or use of other devices, or even causing inconvenience or danger of driving after the automobile vehicle device is plugged into the cigarette lighter slot, and overall design of the automobile vehicle device 1 has to take the configuration position of the cigarette lighter slot for various different automobile vehicles. Therefore, the total volume of the automobile vehicle device 1 is always limited, so that after the socket 10 is inserted into the cigarette lighter slot, there is only a small section of the socket is remained and protruded to the outside, and thus a user cannot grab the socket conveniently by fingers or pull the cigarette lighter out, and such arrangement is inconvenient to use. In addition, the automobile vehicle device 1 is a standalone device which usually provides a single function. If a user wants to use an automobile vehicle device with other functions, then the user will need to pull and remove the cigarette lighter, and thus the frequency of plugging and unplugging the cigarette lighter will be very high, and in turn will cause a high failure rate. On the other hand, if the automobile vehicle device 1 is designed with a multiple of functions to overcome the aforementioned problem, then the total volume will be very large and such design will be unable to meet actual requirements.

In view of the aforementioned drawbacks, the present invention based on years of experience to conduct extensive research and development, and finally provided an automobile vehicle device 1 in accordance with the present invention to overcome the drawbacks of the prior art.

SUMMARY OF THE INVENTION

Therefore, it is a primary objective of the present invention to provide a magnetic automobile vehicle device and a multifunctional module therefore, so that two independent automobile vehicle devices and a charging module attract one another through powerful magnets to achieve a connection easily, so as to improve the applicablility, adaptability and function of the conventional cigarette lighter.

To achieve the aforementioned and other objectives, the present invention provides a magnetic automobile vehicle device obtaining a power supply from a cigarette lighter slot of an automobile vehicle and coupling to an external multifunctional module by magnetic attraction for charging or supplying power, comprising: a main body, with an end plugged into the cigarette lighter slot, and the other end having at least one first magnet; and an impact detector, installed in the main body, and having a signal processing chip, for generating a distress signal when the automobile vehicle is collided.

Wherein, the impact detector comprises a spring and a sensing element, and the spring is coupled the sensing element, and if the automobile vehicle is collided, the spring will be compressed and deformed to produce a restoring force, and the sensing element senses the magnitude of the restoring force, and the impact detector will be triggered to output the distress signal if the restoring force is greater than a tolerance value.

Wherein, the impact detector comprises at least one magnetic element, at least one induction coil and a sensing element, and the magnetic element is installed in the induction coil, and the induction coil is coupled to the sensing element, and if the automobile vehicle is collided, the magnetic element will slide in the axial direction of the induction coil reciprocally, so that the magnetic induction of induction coil forms a current, and the sensing element senses a current value, and the impact detector will be triggered to output the distress signal if the current value is greater than a tolerance value.

Wherein, the impact detector comprises a sliding element, a conductive element and a sensing element, and the conductive element is disposed around at least two opposite sides of the sliding element, and the sensing element is coupled to the conductive element, and if the automobile vehicle is collided, the sliding element will be affected to slide and touch the conductive element reciprocally before forming at least one positive voltage, at least one negative voltage and at least one conduction time, and the sensing element calculates the positive voltage, the negative voltage and the conduction time and compares them with a tolerance value in order to trigger the impact detector to output the distress signal.

In addition, the main body or the multifunctional module comprises a voice converter for receiving a first voice message, translating the first voice message into a desired language, and finally outputs a second voice message, so as to achieve the instant voice translation effect to facilitate the communication between the driver and passengers or tour navigation.

To achieve the aforementioned and other objectives, the present invention further provides a multifunctional module used by a magnetic automobile vehicle device, comprising: a casing, with an end having an output element and the other end having at least one second magnet, and the second magnet being attracted to a first magnet in an external main body, and an end of the main body being plugged into a cigarette lighter slot.

Wherein, the output element is an ultrasonic transmitter, at least one USB slot, a SIM card wireless sharing device, a cigarette lighter, a cigarette lighter socket extender, a fragrance diffuser, an $O_3$ air purifier, a voltage converter, a massager, a fan, a GPS locator, a temperature sensor, a voice converter, or any combination of the above, and at least one signal processing chip is installed between the casing and the main body.

Wherein, the output element comprises the first magnet, so that the casing is provided for extending the magnetic automobile vehicle device.

Wherein, the output element comprises a mobile phone charging stand having a power plug provided for placing an external mobile phone on the mobile phone charging stand and plugging the power plug to charge the rechargeable battery.

In another implementation mode, the casing further comprises a rechargeable battery installed therein and coupled to the output element, and a power supply is obtained from the cigarette lighter slot, and the electric power is stored to form a power bank.

Wherein, the casing has a plug disposed on a side of the casing and electrically coupled to the rechargeable battery, and the plug is provided for connecting a mains power to let the rechargeable battery to store power by using the mains power, and the plug is a foldable or unfoldable plug.

Wherein, the main body with an end having the first magnet includes at least one hook, and the casing with an end having the second magnet includes at least one latch hole configured to be corresponsive to the hook, and the latch hole is provided for latching the hook to fix the main body with the casing.

In summation, the magnetic automobile vehicle device of the present invention is plugged into the cigarette lighter slot directly and considered to be a male terminal, and the multifunctional module is considered as a female terminal, and the male and female terminals are coupled to each other by magnetic attraction to provide a convenient use. The female terminal comes with various different application modes and fits practical and market requirements. In addition to the direct use of the male and female terminals, the male terminal has the built-in the impact detector and thus can be used directly as a safety protecting device of the automobile vehicle. In addition, the female terminal has the built-in the rechargeable battery and thus can be carried or used alone after the charging is completed, and the installation of the plug allows the multifunctional module to charge from utility power, so as to provide the effect of a power bank. Obviously, the present invention has a broad scope of applicability and improves the market satisfaction.

DESCRIPTION OF THE PREFERRED EMBODIMENTS

The above and other objects, features and advantages of this disclosure will become apparent from the following detailed description taken with the accompanying drawings.

Figure 1:
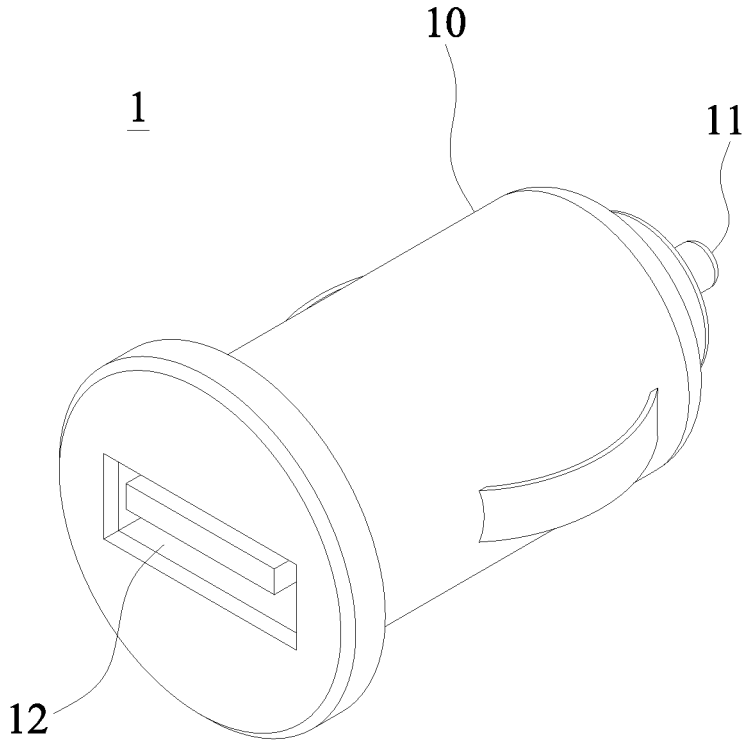
Fig. 1(PRIOR ART)
FIG. 1 is a schematic view of a conventional automobile charger connector.
Figure 2:
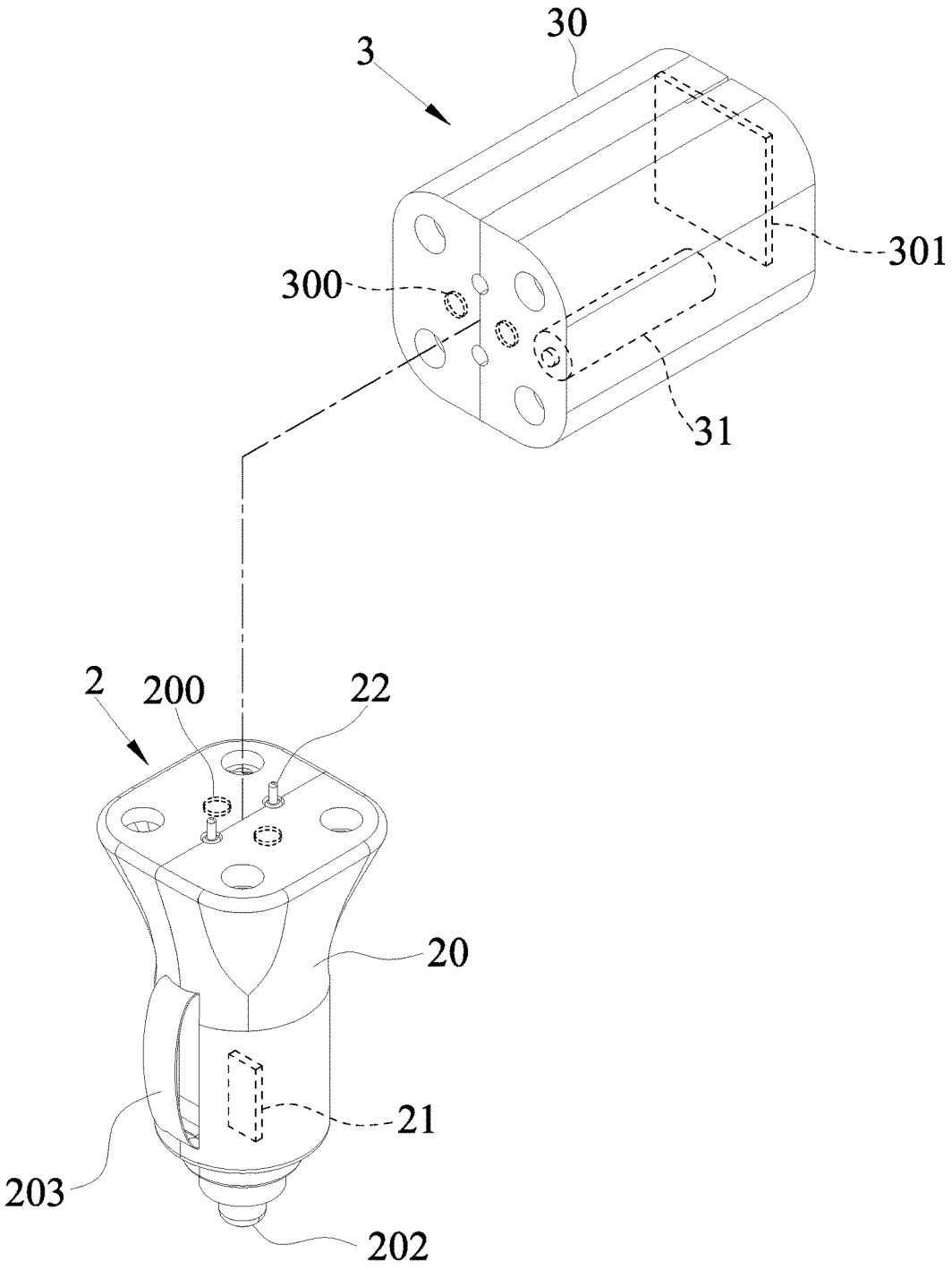
FIG. 2 is a perspective view of a preferred embodiment of the present invention.

With reference to FIG. 2 for a perspective view of a magnetic automobile vehicle device in accordance with a preferred embodiment of the present invention, the magnetic automobile vehicle device 2 is coupled to a multifunctional module 3 by magnetic attraction, and the magnetic automobile vehicle device 2 comprises a main body 20 and an impact detector 21, and the multifunctional module 3 comprises a casing 30 and a rechargeable battery 31, and at least one signal processing chip (not shown in the figure) is installed between the main body 20 and the casing 3. An end of the main body 20 is plugged into a cigarette lighter slot of an automobile vehicle, and the other end of the main body 20 has at least one first magnet 200, and the impact detector 21 is installed in the main body 20. The rechargeable battery 31 is installed in the casing 30, and an end of the casing 30 has an output element 301, and the other end of the casing has at least one second magnet 300, so that the second magnet 300 and the first magnet 200 are attracted to attach the casing 30 to the main body 20, and the output element 301 is electrically coupled to the rechargeable battery 31. The magnetic automobile vehicle device 2 obtains a power supply from the cigarette lighter slot to drive the operation of the impact detector 21, so that if a collision of the automobile vehicle is detected, a distress signal will be generated, and the rechargeable battery 31 will use the power supply for charging or supplying power, and the multifunctional module 3 will use the power supply of the main body 20 to store electric power, so as to form a power bank.

In this preferred embodiment, the first magnet 200 and the second magnet 300 may be neodymium magnets, samarium cobalt magnets or electromagnets, but the invention is not limited to these types of magnets, and the initial status of the rechargeable battery 31 may be slightly charged or not charged at all. In other words, the multifunctional module 3 may or may not come with a power supply. The magnetic automobile vehicle device 2 may transmit electric power, data, voltage, signal, or heat with the multifunctional module 3 through at least one probe of a high speed signal connector (Pogo Pin) 22, a bracket or a pin, or the magnetic automobile vehicle device 2 may transmit power, data, voltage, signal or message with the multifunctional module 3 by wireless charging and wireless transmission technologies. The high speed signal connector 22 is not limited to be installed to the main body 20 or the casing 30. The impact detector 21 and the multifunctional module 3 may be used separately or jointly to detect the collision of the automobile vehicle by the signal processing chip, or records and detected data may be stored by the signal processing chip and provided for an external disc reader, or directly uploaded to a cloud database by the signal processing chip.

Figure 3:
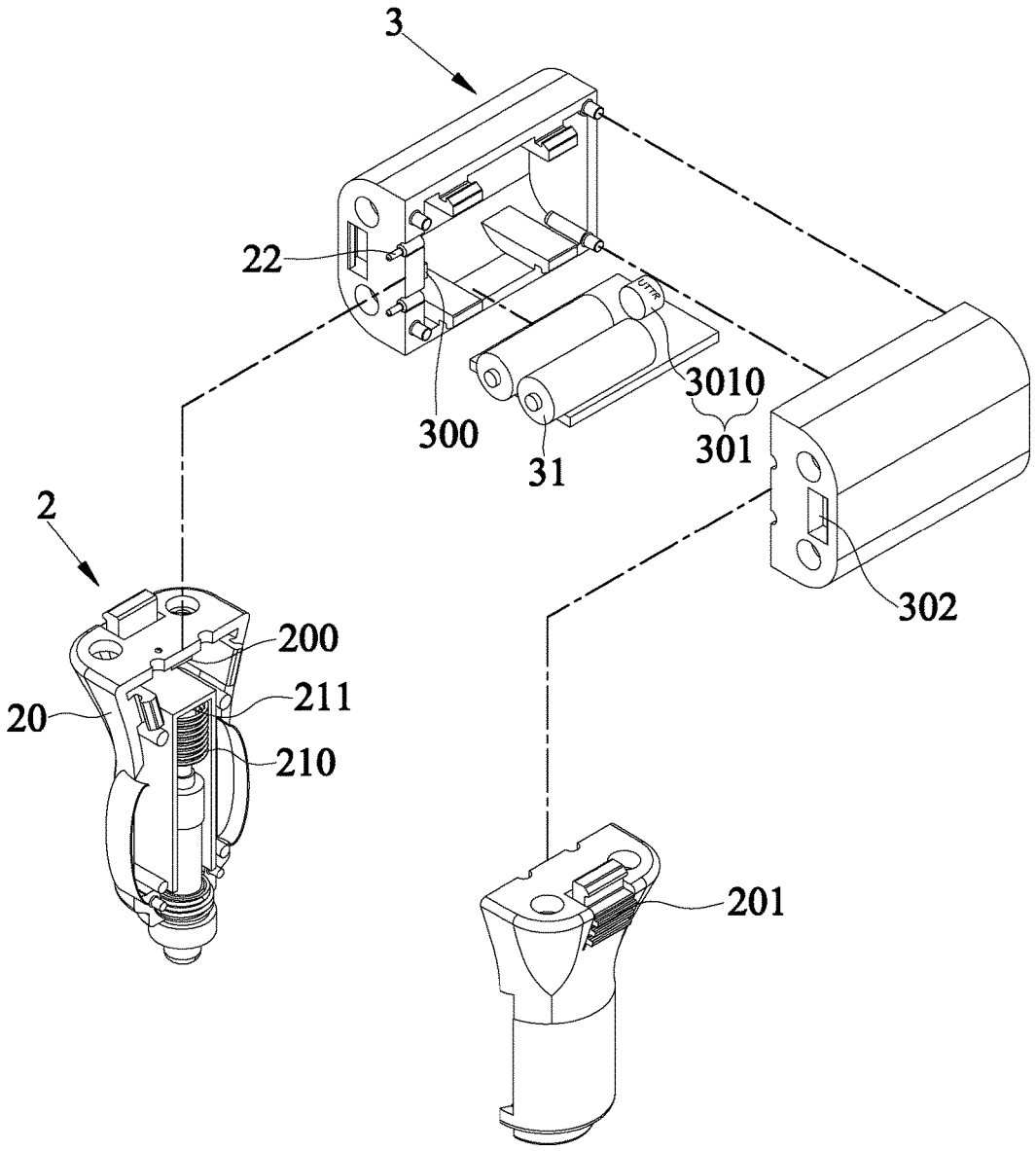
FIG. 3 is an exploded view of a first implementation mode of a preferred embodiment of the present invention.
Figure 4:
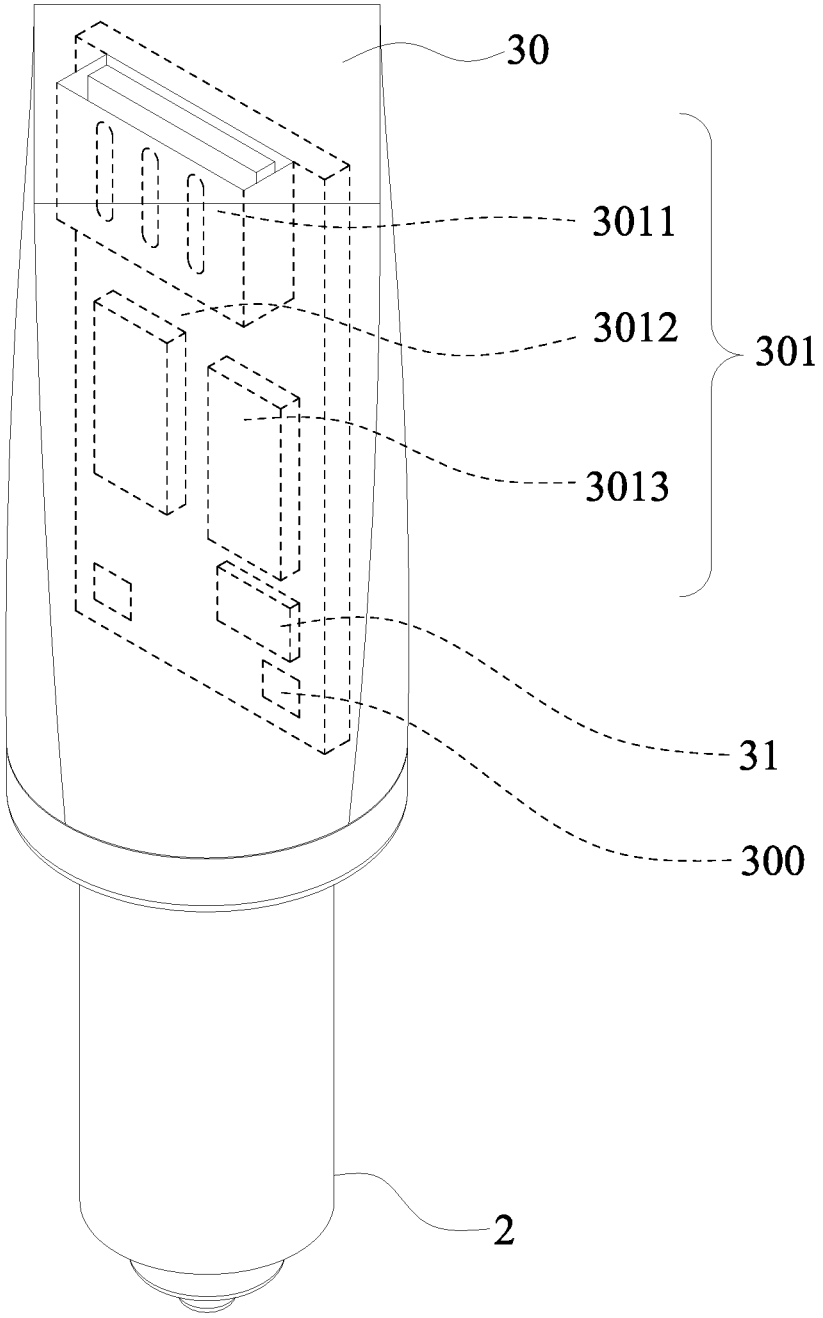
FIG. 4 is an exploded view of a second implementation mode of a preferred embodiment of the present invention.

With reference to FIGS. 3 and 4 for the exploded views of the first and second implementation modes of a preferred embodiment of the present invention respectively, the main body 20 with an end having the first magnet 200 includes at least one hook 201, and the casing 30 with an end having the second magnet 300 includes at least one latch hole 301, and the latch hole 301 is provided for latching the hook 201 to fix the main body 20 with the casing 30. In some other embodiments, hook 201 may not be presented. The impact detector 21 comprises a spring 210 and a sensing element 211, and the spring 210 is coupled to the sensing element 211. If the automobile vehicle is collided, the spring 210 will be compressed and deformed to produce a restoring force, and the sensing element 211 will sense the magnitude of the restoring force. If the restoring force is greater than a tolerance value, then the impact detector 21 will be triggered to cause the signal processing chip to output the distress signal. In addition, the impact detector 21 comprises at least one magnetic element, at least one induction coil and a sensing element (not shown in the figure), and the magnetic element is installed in the induction coil, and the induction coil is coupled to the sensing element. If the automobile vehicle is collided, the magnetic element will slide in an axial direction of the induction coil reciprocally, so that the magnetic induction of the induction coil forms a current, and the sensing element will sense the magnitude of the current value. If the current value is greater than a tolerance value, then the impact detector 21 will be triggered to cause the signal processing chip to output the distress signal. The impact detector 21 further comprises a sliding element, a conductive element and a sensing element (not shown in the figure), and the conductive element is disposed around at least two opposite sides of the sliding element, and the sensing element is coupled to the conductive element. If the automobile vehicle is collided, the sliding element will be affected to slide and touch the conductive element before forming at least one positive voltage, at least one negative voltage and at least one conduction time, so that the sensing element will calculate the positive voltage, the negative voltage and the conduction time and compare them with a tolerance value, so as to trigger the impact detector 21 to cause the signal processing chip to output the distress signal.

The casing 30 is in a cylindrical, rectangular column, polygonal column, circular cone, rectangular cone, spherical, or any other shape, and the output element 301 has an ultrasonic transmitter 3010, at least one USB slot 3011, a GPS locator 3012, a SIM card wireless sharing device 3013, a cigarette lighter, a cigarette lighter socket extender 3014, a fragrance diffuser, an $O_3$ air purifier, a voltage converter, a massager, a fan, a temperature sensor, a voice converter, or any combination of the above. The ultrasonic transmitter 3010 is provided for producing ultrasonic to drive insects or small animals in or around the automobile vehicle, and the USB slot 3011 is provided for installing a USB plug to allow an external electronic device to electrically connect to the rechargeable battery 31 through the USB plug and the USB slot 3011. The SIM card wireless sharing device 3013 is provided for generating a wireless signal to create a wireless networking environment in the automobile vehicle. The cigarette lighter is provided for generating heat to light a cigarette, and the cigarette lighter socket extender has at least one cigarette lighter jack, and the fragrance diffuser is provided for heating a volatile material to produce fragrance, and the $O_3$ air purifier has a built-in high voltage discharger/generator to produce ozone and clean the air in/around the automobile vehicle. The voltage converter has a plurality of sockets with different specifications and each of the sockets supply voltages of different voltage values. The massager is capable of providing a vibrating effect to offer a comfortable massage to users, and the fan is provided for causing airflows to lower the temperature in/around the automobile vehicle, and the GPS locator calculates and displays the current position and traveling direction of the automobile vehicle, and the temperature sensor instantly detects and displays the temperature in/around the automobile vehicle. The voice converter is provided for receiving a first voice message, translating the voice message into a desired language via Internet or a native language database, and outputting a second voice message. It is noteworthy that the ultrasonic transmitter 3010, the USB slot 3011, the GPS locator 3012, the SIM card wireless sharing device 3013, the cigarette lighter, the cigarette lighter socket extender 3014, the fragrance diffuser, the $O_3$ air purifier, the voltage converter, the massager, the fan, the temperature sensor and the voice converter may be operated separately or electrically coupled to he signal processing chip.

Figure 5:
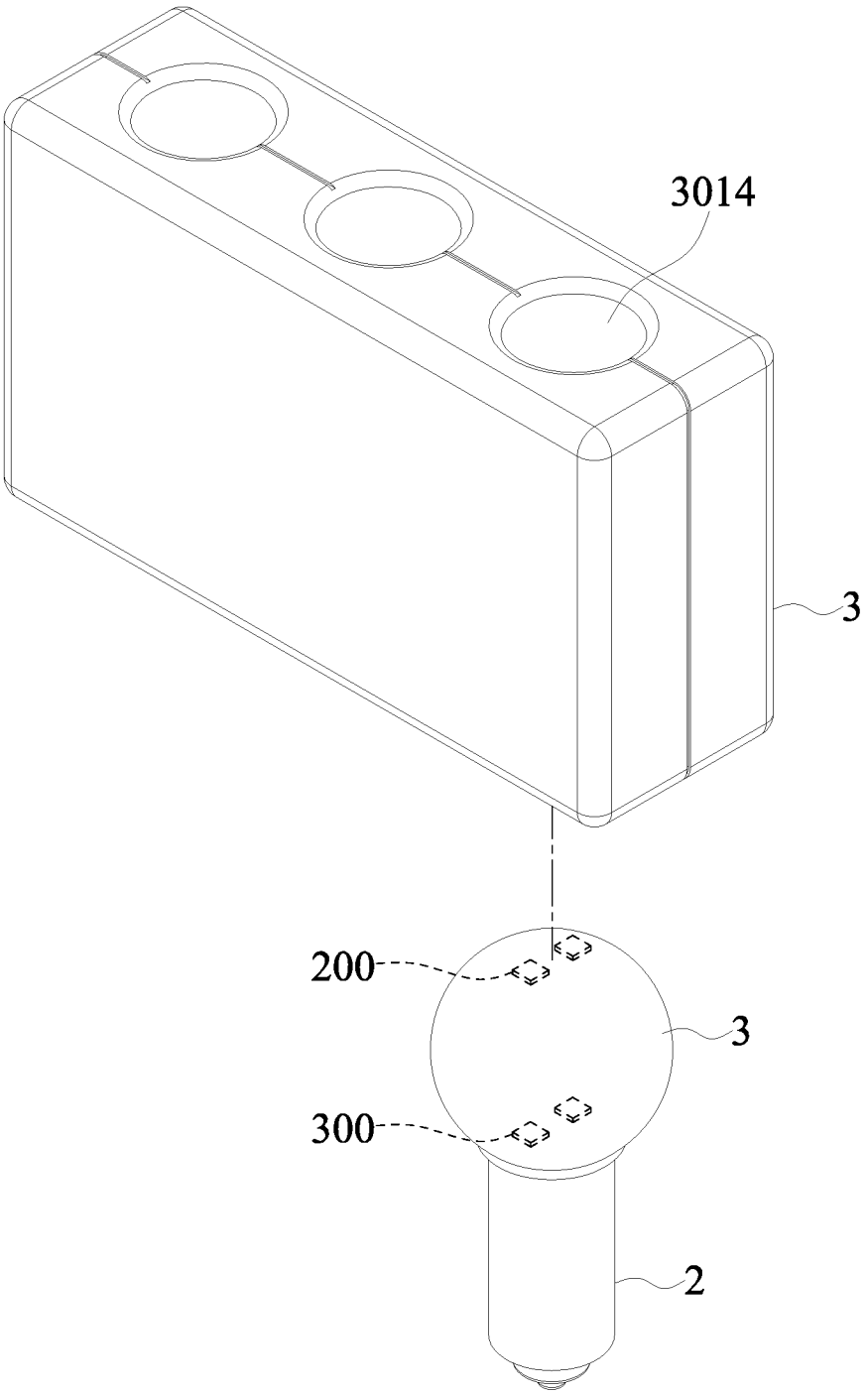
FIG. 5 is a schematic view of a third implementation mode of a preferred embodiment of the present invention.

With reference to FIG. 5 for the third implementation mode, the output element 301 may have the first magnet 200, so that the casing 30 extends the use of the magnetic automobile vehicle device 2. In other words, the multifunctional module 3 may act as the magnetic automobile vehicle device 2 or an extension of another multifunctional module 3 and the single magnetic automobile vehicle device 2 may be combined with a plurality of multifunctional modules 3. For example, the multifunctional module 3 of the cigarette lighter socket extender 3014 can be used easily without being affected by the configuration of other devices.

Figure 6:
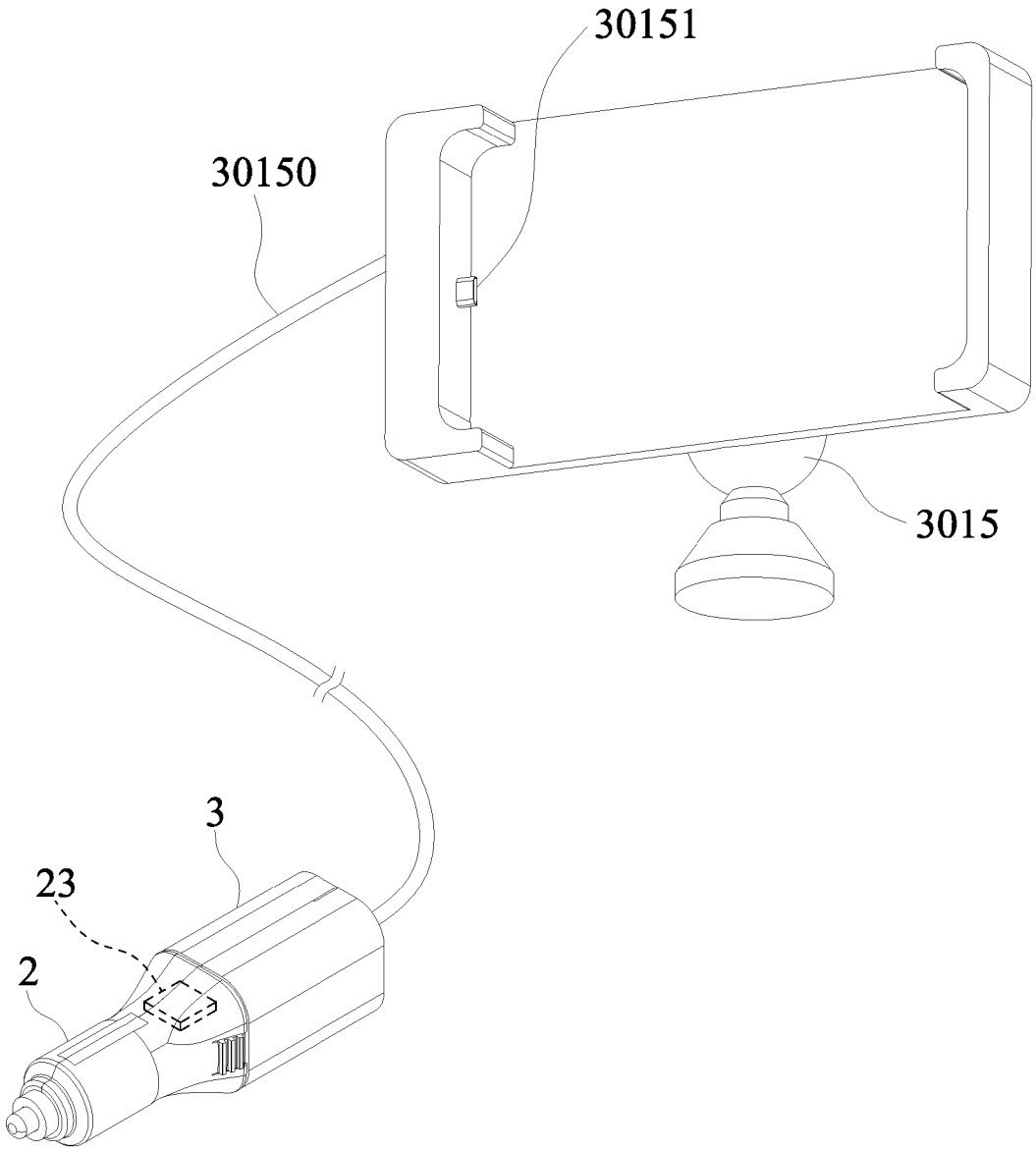
FIG. 6 is a schematic view of an application in accordance with a fourth implementation mode of a preferred embodiment of the present invention.

With reference to FIG. 6 for the four implementation mode, the main body 20 has a voice converter 23 installed therein. In other words, the voice converter 23 may be installed in the magnetic automobile vehicle device 2 or the multifunctional module 3, or the components of the voice converter 23 may be installed separately in both of the magnetic automobile vehicle device 2 and the multifunctional module 3. For example, a voice receiver is installed in the multifunctional module 3, and a native language database is installed in the magnetic automobile vehicle device 2 and provided for receiving a first voice message, translating the voice message into a desired language, and outputting a second voice message. In addition, the output element 301 includes a mobile phone charging stand 3015 having a USB cable 30150 and a power plug 30151, and the mobile phone charging stand 3015 is provided for placing an external mobile phone to the mobile phone charging stand 3015 and plugging the power plug 30151 to charge the rechargeable battery 31. The USB cable 30150 may be connected through the USB slot 3011 of the casing 30, so that the mobile phone charging stand 3015 and the casing 30 form two separated modules, or the USB cable 30150 is integrally extended to the casing 30. However, in some embodiments, the rechargeable battery 31 may not be provided.

Figure 7:
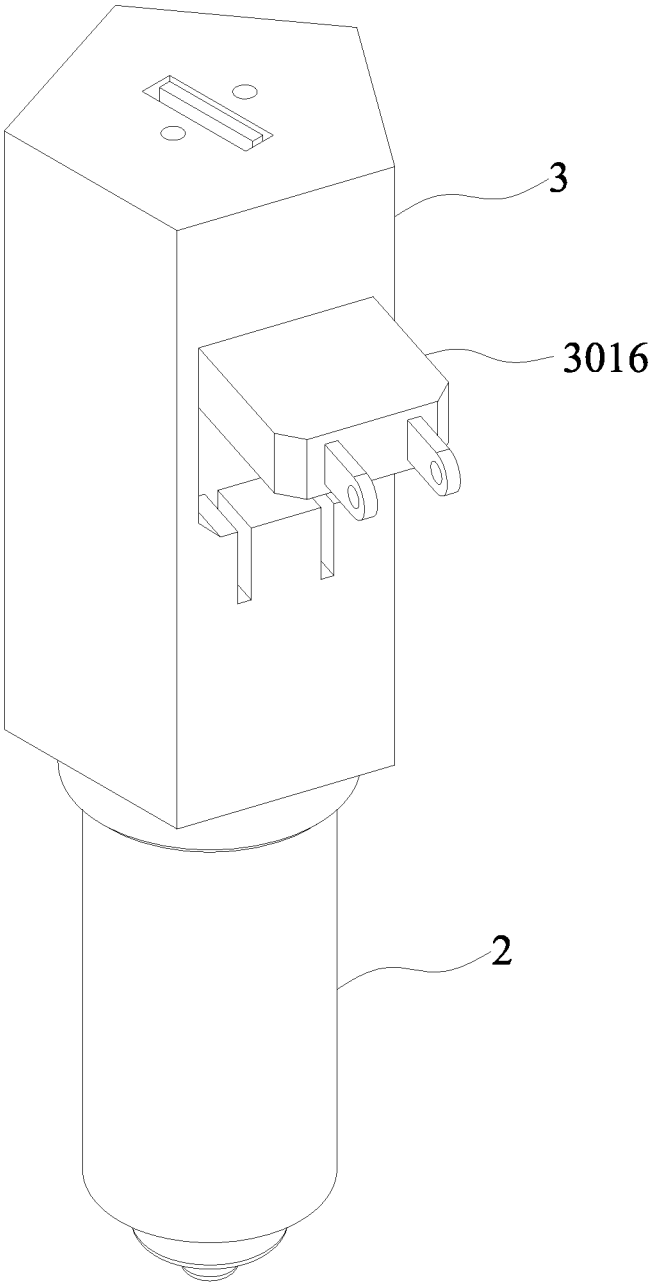
FIG. 7 is a schematic view of an application in accordance with a fifth implementation mode of a preferred embodiment of the present invention.
Figure 8:
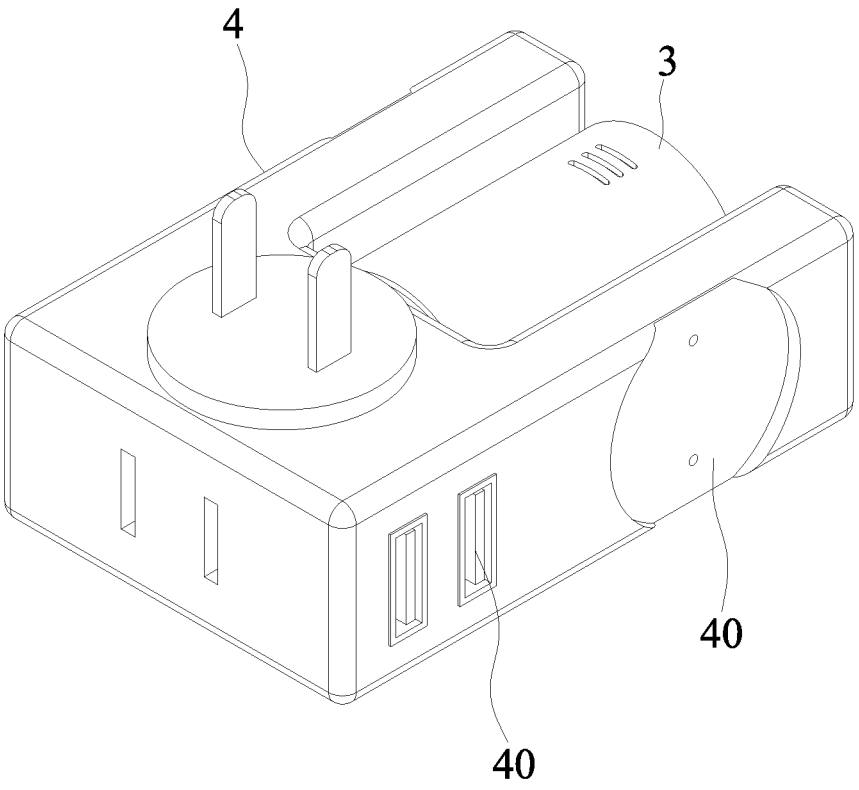
FIG. 8 is a schematic view of an application in accordance with a sixth implementation mode of a preferred embodiment of the present invention.

With reference to FIG. 7 for the fifth implementation mode, it is noteworthy that the casing 30 has a plug 3016 installed to a side of the casing 30 and electrically coupled to the rechargeable battery 31, and the plug 3016 is plugged to a mains power to allow the rechargeable battery 31 to store electric power by the mains power, and transmit data, voltage, signal, or message. Therefore, the multifunctional module 3 may be used together with the magnetic automobile vehicle device 2 in the automobile vehicle or carried by a user without having the limitation of location. Notice that in some embodiments, the rechargeable battery 31 may not be provided. The plug 3016 may be a foldable or unfoldable plug, and the casing 30 may be connected to an external socket extender which has the plug 4 as shown in FIG. 8 to facilitate users to support the operation of the multifunctional module 3 by using the mains power. The socket extender 4 has a plurality of power jacks 40 for charging the multifunctional modules 3 of different specifications, plugging a USB cable to charge any 3C product.

Figure 9:
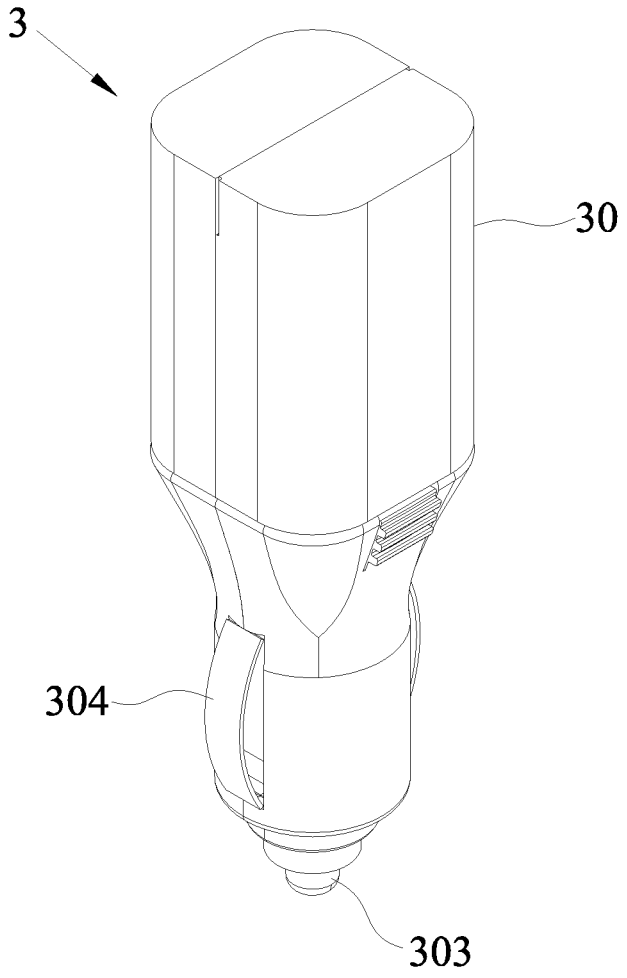
FIG. 9 is a schematic view of an application in accordance with a seventh implementation mode of a preferred embodiment of the present invention.

With reference to FIG. 9 for another implementation mode, in this embodiment, the multifunctional module comprises a casing, and an end of the casing has an output element. The other end of the casing is integrally connected to a main body. No additional connecting mechanism between the main body and the casing is presented in this embodiment. And an end of the main body can be plugged into a cigarette lighter slot for receiving power supply. The main body comprises a positive terminal 303 and a negative terminal 304. The positive terminal 303 is provided on the end of the main body, and the negative terminal 304 is provided on a lateral face of the main body. In this embodiment, the main body has a substantially cylindrical geometry. Therefore, the surface on the end of the main body is substantially orthogonal to the lateral face of the main body.

What is claimed is:

1. A magnetic automobile vehicle device, obtaining a power supply from a cigarette lighter slot of an automobile vehicle and coupling to an external multifunctional module by magnetic attraction for charging or supplying power, comprising:

a main body, with an end plugged into the cigarette lighter slot, and the other end having at least one first magnet;

wherein, the main body further comprises a positive terminal and a negative terminal, the positive terminal and the negative terminal are formed on the end of the main body and a lateral side of the main body respectively, wherein the magnetic automobile vehicle device further comprises an impact detector, installed in the main body, and having a signal processing chip, for generating a distress signal when the automobile vehicle is collided, wherein the impact detector comprises a spring and a sensing element, and the spring is coupled the sensing element, and if the automobile vehicle is collided, the spring will be compressed and deformed to produce a restoring force, and the sensing element senses a magnitude of the restoring force, and the impact detector will be triggered to cause the signal processing chip to output the distress signal if the restoring force is greater than a tolerance value.

2. The magnetic automobile vehicle device according to claim 1, wherein the main body or the multifunctional module comprises a voice converter for receiving a first voice message, translating the first voice message into a desired language, and finally outputs a second voice message.

3. A magnetic automobile vehicle device, obtaining a power supply from a cigarette lighter slot of an automobile vehicle and coupling to an external multifunctional module by magnetic attraction for charging or supplying power, comprising:

a main body, with an end plugged into the cigarette lighter slot, and the other end having at least one first magnet;

wherein, the main body further comprises a positive terminal and a negative terminal, the positive terminal and the negative terminal are formed on the end of the main body and a lateral side of the main body respectively, wherein the magnetic automobile vehicle device further comprises an impact detector, installed in the main body, and having a signal processing chip, for generating a distress signal when the automobile vehicle is collided, wherein the impact detector comprises at least one magnetic element, at least one induction coil and a sensing element, and the magnetic element is installed in the induction coil, and the induction coil is coupled to the sensing element, and if the automobile vehicle is collided, the magnetic element will slide in an axial direction of the induction coil reciprocally, so that a magnetic induction of induction coil forms a current, and the sensing element senses a current value, and the impact detector will be triggered to cause the signal processing chip to output the distress signal if the current value is greater than a tolerance value.

4. The magnetic automobile vehicle device according to claim 3, wherein the main body or the multifunctional module comprises a voice converter for receiving a first voice message, translating the first voice message into a desired language, and finally outputs a second voice message.

5. A magnetic automobile vehicle device, obtaining a power supply from a cigarette lighter slot of an automobile vehicle and coupling to an external multifunctional module by magnetic attraction for charging or supplying power, comprising:

a main body, with an end plugged into the cigarette lighter slot, and the other end having at least one first magnet;

wherein, the main body further comprises a positive terminal and a negative terminal, the positive terminal and the negative terminal are formed on the end of the main body and a lateral side of the main body respectively, wherein the magnetic automobile vehicle device further comprises an impact detector, installed in the main body, and having a signal processing chip, for generating a distress signal when the automobile vehicle is collided, wherein the impact detector comprises a sliding element, a conductive element and a sensing element, and the conductive element is disposed around at least two opposite sides of the sliding element, and the sensing element is coupled to the conductive element, and if the automobile vehicle is collided, the sliding element will be affected to slide and touch the conductive element reciprocally and form at least one positive voltage, at least one negative voltage and at least one conduction time, and the sensing element calculates the positive voltage, the negative voltage and the conduction time and compares them with a tolerance value in order to trigger the impact detector to cause the signal processing chip to output the distress signal.

6. The magnetic automobile vehicle device according to claim 5, wherein the main body or the multifunctional module comprises a voice converter for receiving a first voice message, translating the first voice message into a desired language, and finally outputs a second voice message.

* * * * *